United States Patent [19]

Meccariello et al.

[11] Patent Number: 5,003,572

[45] Date of Patent: Mar. 26, 1991

[54] AUTOMATIC BRIGHTNESS COMPENSATION FOR X-RAY IMAGING SYSTEMS

[75] Inventors: Thomas V. Meccariello, Eagle; Barry F. Belanger, Elm Grove, both of Wis.

[73] Assignee: General Electric Company, Milwaukee, Wis.

[21] Appl. No.: 505,792

[22] Filed: Apr. 6, 1990

[51] Int. Cl.[5] ..... H05G 1/64; H05G 1/44

[52] U.S. Cl. ..... 378/99; 378/97; 378/108; 378/109; 378/111

[58] Field of Search ..... 378/97, 98, 99, 108

[56] References Cited

U.S. PATENT DOCUMENTS

| | | | |
|---|---|---|---|
| 3,783,286 | 1/1974 | Kremer | 378/98 |
| 4,158,138 | 6/1979 | Hellstrom | 378/108 |
| 4,171,484 | 10/1979 | Hunt | 378/108 |
| 4,309,613 | 1/1982 | Brunn et al. | 378/97 |
| 4,454,606 | 6/1984 | Relihan | 378/97 |
| 4,473,843 | 9/1984 | Bishop et al. | 378/99 |
| 4,573,183 | 2/1986 | Relihan | 378/108 |
| 4,590,603 | 5/1986 | Relihan et al. | 378/108 |
| 4,639,943 | 1/1987 | Heinze et al. | 378/96 |
| 4,703,496 | 10/1987 | Meccariello et al. | 378/99 |
| 4,797,905 | 1/1989 | Ochmann et al. | 378/108 |
| 4,809,309 | 2/1989 | Beekmans | 378/99 |

*Primary Examiner*—Edward P. Westin
*Assistant Examiner*—Kim-Kwok Chu
*Attorney, Agent, or Firm*—Quarles & Brady

[57] ABSTRACT

The brightness of an X-ray video image during fluorography is maintained at a substantially constant level by a control circuit which varies the X-ray dose in relation to changes in the average brightness of the X-ray image. As the X-ray system approaches the limits of its imaging capability, varying the X-ray dose alone may not yield the desired brightness level. At this point, the gain applied to the video signal is increased to improve the brightness. A linear brightness taper function is used such that, as the level of video gain required to maintain constant brightness increases, the actual video gain increases by a smaller proportional amount. This function results in the brightness of the video image decreasing somewhat as the video gain is required to provide a greater degree of brightness compensation. This reduction in brightness not only provides a visual indication to the image observer that the system is approaching the imaging limits, but also creates an illusion that noise artifacts in the image are not intensifying as the video gain increases.

23 Claims, 3 Drawing Sheets

X-RAY IMAGING SYSTEM 10
KV COMMAND
PULSE WIDTH COMMAND
FILAMENT COMMAND
VIDEO GAIN COMMAND
EXPOSURE CONTROL 60
OPERATOR TERMINAL
MONITOR
VIDEO GAIN CONTROL
AVERAGING CIRCUIT
VIDEO CAMERA
IMAGE INTENSIFIER
GRID SUPPLY
FILAMENT SUPPLY
HIGH VOLTAGE SUPPLY
10
12
13
14
15
16
17
18
20
22
24
26
28
30
31
32
33
34
35
36
37
38
40
42
44
46
48
49
50
51
52
54
58
62
65

AUTOMATIC BRIGHTNESS COMPENSATION FOR X-RAY IMAGING SYSTEMS

BACKGROUND OF THE INVENTION

The present invention pertains to X-ray imaging apparatus, and in particular, to automatic brightness control systems for such apparatus.

During a fluoroscopic examination of a patient, an X-ray image is displayed on the screen of a video monitor. To produce this image, the X-rays passing through a patient are detected by an image intensifier tube, which converts the X-ray image into a visible light image. A video camera receives the visible light image from the intensifier tube and produces a video signal for the monitor, which displays the patient image.

When the X-ray beam scans different portions of the patient, the brightness of the video image will change due to variations in the attenuation of the X-ray beam as it passes through different thicknesses and densities of body tissue and bone. In order to compensate for these variations in image brightness, various automatic compensation systems have been devised. One such system is described in U.S. Pat. No. 4,703,496 entitled "Automatic X-Ray Imager Brightness Control" and issued to the same assignee as the present invention. When this X-ray apparatus was operated in the fluorography mode, the luminances of picture elements in each video image field were averaged to produce a signal having a voltage proportional to the average image brightness.

The average brightness measurement is used as a feedback signal to control the excitation of the X-ray tube and the video gain of the apparatus to maintain the video image brightness substantially constant at an optimum level. The brightness control circuit comprised three separate loops for regulating tube current, bias voltage and video gain. In the X-ray tube current control loop, the ratio of a reference voltage to the measured average brightness voltage was determined. If this brightness ratio did not equal unity, an X-ray tube current controller adjusted the current level to eliminate the deviation of the actual brightness from the reference level. A value proportionate to the adjusted current level was stored until another brightness ratio was calculated for the next video image field.

In the X-ray tube bias voltage control loop, an error ratio of the stored current level value to a defined current limit was derived. This error ratio was multiplied by the present image's brightness ratio to provide a bias voltage control ratio indicative of how much of the brightness error the bias voltage control loop is obliged to correct. The bias voltage control ratio was corrected for nonlinearity between bias voltage change, and image brightness change and the resulting corrected value formed a bias voltage command which adjusted the voltage applied to the X-ray tube anode.

The video gain control loop calculated a first ratio between the tube current command for the last video field and a maximum current command limit; and derived a second ratio of the brightness change resulting from the last bias voltage control command to a maximum brightness change factor. The result of multiplying the last two mentioned ratios with the present image's brightness ratio became a new video gain control signal. The new video gain control signal varied the f-stop of the video camera and the electronic gain which also affected the image brightness. As a result of the way in which the previous tube current and bias voltage levels were ratioed in the control system, the X-ray tube current, bias voltage and video gain were concurrently adjusted on a priority basis in the stated order.

The primary effect on brightness is obtained most desirably with tube current control, the secondary effect with tube bias voltage control. It is least desirable to adjust image brightness with video gain control, because in addition to brightening the displayed X-ray image, increasing the electronic gain also increased the intensity of noise artifacts affecting the image. As the noise increased, the display became "grainer" which was unsatisfactory to the user. This adverse effect often confused the operator who did not recognize deterioration in the display image as indicating that the X-ray system was approaching the limit of its imaging range at the selected dose level. The operator expected the image to become darker as the imaging limit approached, as occurred in systems without automatic brightness control.

SUMMARY OF THE INVENTION

An X-ray diagnostic system includes a means for converting the X-ray image into a visible light image. A camera receives the visible light image and produces a video image signal comprising a series of picture elements having specific luminance levels. The video image is fed to a monitor which provides a display of the image to the operator of the system.

A control circuit regulates the brightness of the video image to maintain a satisfactory image display. In order to perform its function, the control circuit processes the luminance of selected picture elements to derive an indication of the average brightness of the video image. The derived average brightness indication is compared to a reference level to determine the brightness deviation from the reference level. Based on the brightness deviation, the control circuit regulates the X-ray tube excitation to vary the X-ray dose rate in order to alter the brightness of the video image until it is equivalent to the reference level.

When altering the tube excitation alone cannot maintain a desirable image brightness, the control circuit begins adjusting the video gain applied to the video signal to improve the brightness of the displayed video image. The balance of the brightness deviation that remains after altering the tube excitation indicates the video gain required to achieve the reference brightness level. Instead of adjusting the actual video gain to the required level as in previous systems, the actual video gain is a given fraction of the required video gain level. The function defining the relationship between required video gain and the actual gain preferably depends upon the particular one of several dose rates selected by the operator. Therefore, as the required video gain level increases, the brightness of the video image actually decreases, thereby providing an indication to the image viewer that the system is approaching the limit of its imaging capability. A minimum level below which the image brightness may not be decreased is provided in the disclosed circuit.

In the preferred embodiment of the X-ray diagnostic system, the video gain can be varied by altering the size of a camera iris and the gain of a video signal amplifier, either alone or in combination. When the control circuit specifies that the video gain increase is necessary, the amplifier gain is increased up to a set level. Thereafter, additional video gain is provided by opening the camera iris until it is fully open. If still more video gain is necessary, the amplifier gain is increased above the set level while the iris is held fully open. The inverse occurs when a video gain reduction is required to lower the image brightness.

A general object of the present invention is to provide a mechanism for regulating the brightness of a video display of an X-ray image to obtain a visually acceptable display.

A more specific object is to maintain the brightness of the display at substantially a constant level by initially varying the X-ray exposure.

Another object is that when merely varying the exposure level is insufficient, the video gain of the system is altered to increase display brightness. However, as greater levels of video gain are required to maintain a constant image brightness, the actual video gain provided results in a rolloff of the display brightness as the imaging limits of the system approach.

DETAILED DESCRIPTION OF THE INVENTION

Figure 1:
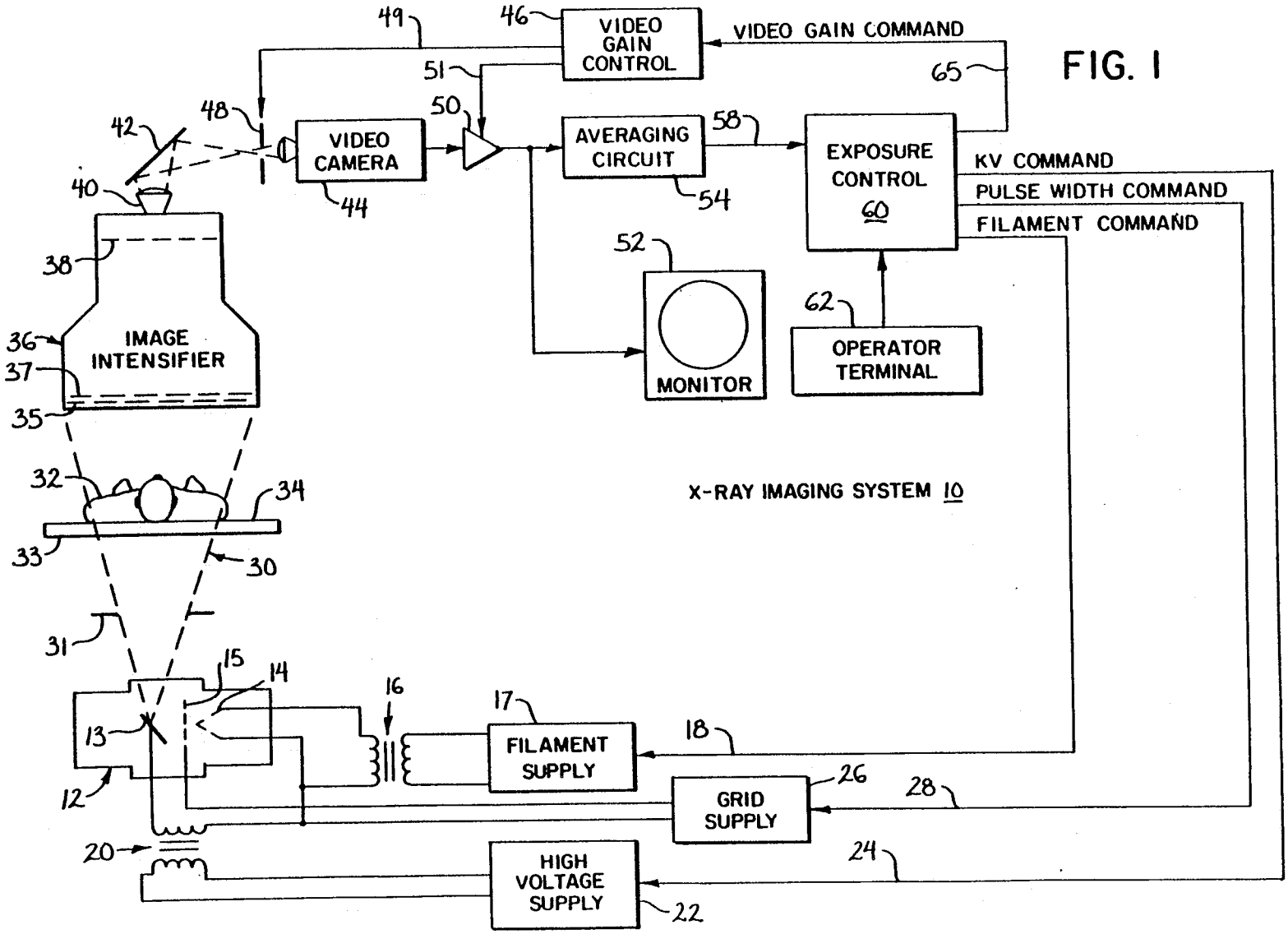
FIG. 1 is a block schematic diagram of an X-ray imaging system having automatic image brightness control according to the present invention.

FIG. 1 illustrates the functional components of a fluoroscopic X-ray imaging system 10. The system incorporates a conventional X-ray tube 12 having a rotating anode 13, a combined cathode/filament 14 and a control grid 15. The filament current is supplied by a filament transformer 16 driven by a conventional power supply 17. The filament power supply 17 regulates the current furnished to the primary winding of the filament transformer 16 in response to a control signal on line 18. The X-ray tube current, expressed in milliamperes (mA), flowing between the anode 13 and the cathode filament 14 when a high bias voltage is applied therebetween is dependent in part on the filament current.

The kilovolt (kV) anode to cathode bias is supplied from a high voltage step-up transformer 20 having a secondary winding coupled between the anode 13 and the cathode/filament 14. The primary winding of the step-up transformer 20 is connected to the output of a standard high voltage power supply 22, which is controlled in a conventional manner by a signal, designated kV COMMAND on line 24. The control grid 15 is biased by a grid power supply 26 in response to a signal, designated PULSE WIDTH COMMAND, on line 28. This signal defines the duration of each X-ray pulse when the system is in a pulsed fluoroscopic mode. In addition to varying the filament current and the kV bias voltage, the X-ray image brightness can be controlled by regulating the duration that the X-ray tube is pulsed on which controls the average tube current (mA). In the continuous (non-pulsed) fluoroscopic mode, the PULSE WIDTH COMMAND controls the grid electrode bias level to regulate the electron beam current within tube 12.

When properly excited, the X-ray tube 12 emits a beam of X-rays as depicted by dashed lines 30. A shutter 31 is manually adjusted during system set-up to define the shape of beam 30. As illustrated in FIG. 1 the X-ray tube 12 is positioned beneath a patient 32 lying on a table 33 which is transparent to the X-ray beam 30.

A conventional X-ray image intensifier 36 is positioned to receive the X-rays which pass through the patient 32. The image intensifier 36 includes an X-ray sensitive input phosphor screen 35, a photocathode 37, and an output phosphor screen 38. The impingement of X-rays on the input phosphor screen 35 generates visible light which is directed toward the photocathode 37. This light causes the photocathode 37 to emit electrons which are amplified by an electron multiplier (not shown) in the image intensifier 36. The electrons from the electron multiplier strike the output phosphor screen 38 generating a visible light output image.

The output image from the image intensifier 36 is projected by lens 40 and reflector 42 to a video camera 44. A variable iris 48 is in front of the video camera 44 and is controlled by a video gain control circuit 46 to alter the amount of light entering the video camera 44. As will be described in detail, the video gain control circuit 46 issues a signal over line 49 which opens or closes the iris 48 to a given aperture size.

The video signal from camera 44 is amplified by a variable gain amplifier 50 and fed to a monitor 52 which produces an image for viewing by medical personnel. The gain of amplifier 50 is controlled by a signal on line 51 from the video gain control circuit 46. The output signal from the amplifier 50 also is coupled to an averaging circuit 54 which produces an output on line 58 indicative of the average image brightness level of each video field. The details of the brightness averaging circuit 54, that averages the luminance component of the video signal, are disclosed in U.S. Pat. No. 4,573,183, which is incorporated by reference herein. The average brightness indication signal is fed at the end of the video field over line 58 to an exposure control 60.

The exposure control 60 also receives input commands from an operator terminal 62. This terminal 62 permits the operator to choose the mode of operation (pulsed or continuous fluoroscopic) and to select among a group of predefined dose rates for an X-ray exposure. For descriptive purposes, the illustrated system has three predefined dose rates referred to as low, medium and high. However, the present brightness control technique may be used with any number of dose rates. The operator terminal 62 also provides a visual indication of different operating parameters of the X-ray system 10.

The exposure control 60 regulates the X-ray tube emission in response to the exposure parameters selected by the operator and the average image brightness signal on line 58. To do so the exposure control 60 produces three control signals designated FILAMENT COMMAND, kV COMMAND and PULSE WIDTH COMMAND which regulate the filament supply 17, high voltage supply 22 and grid supply 26, respectively.

The exposure control 60 determines by what amount, if any, the present average brightness level deviates from a desired level. This deviation is used to determine the degree to which each of the X-ray three tube control signals and the video gain should be altered to achieve the desired brightness level. As all of these system parameters affect the brightness of the displayed image, a predictive technique is used to determine the mix of parameter variation required to compensate for a given brightness deviation. This prediction is done on a priority basis. The exposure control 60 first determines whether the tube current can be varied enough to produce the desired change in brightness. If varying the tube current to its full permissible limit is insufficient, the tube bias voltage also will be altered to achieve the desired image brightness. In other words, the control mechanism anticipates that the instantaneous circumstances require a bias voltage adjustment and starts varying the KV COMMAND concurrently with changes to the FILAMENT CURRENT COMMAND. The tube bias voltage should be raised no more than is necessary, because as it increases image contrast degrades.

However, if the prediction technique determines that increasing tube current and bias voltage to their acceptable limits will not achieve the desired image brightness, the video gain also must be adjusted. Increasing the video gain is a last resort as it does not produce any more image information and does intensify undesirable noise in the image signal. Thus, the predictive brightness control technique used by the exposure control 60 alters tube current, bias voltage and video gain on a priority basis in that order. When a large alteration in brightness is demanded, a mix of altering all three parameters may be required.

Figure 2:
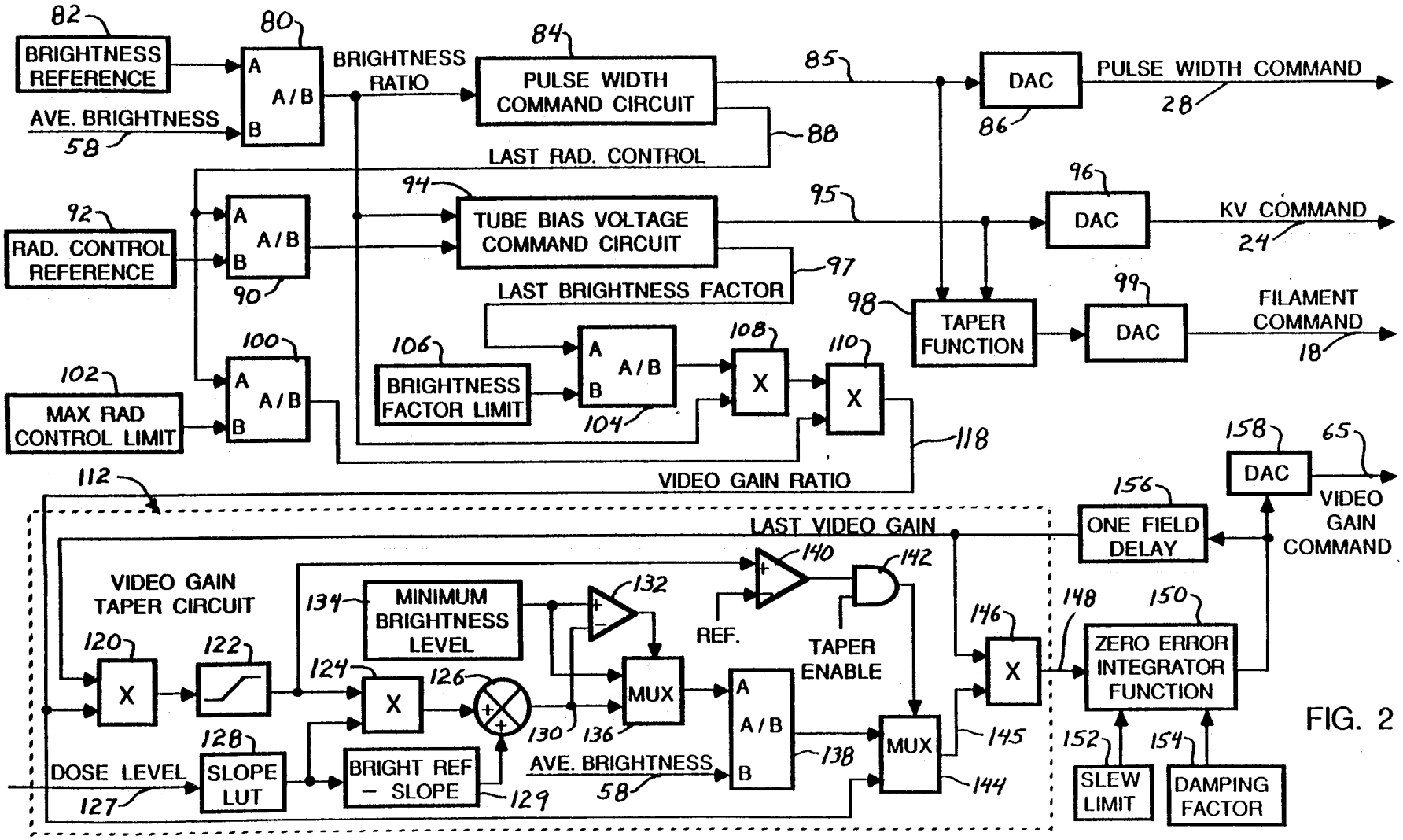
FIG. 2 is a block schematic diagram of the exposure control in FIG. 1.

The details of the exposure control 60 are shown in FIG. 2 and are being described in terms of discrete digital processing components although the same functions could be performed by a microcomputer. The output from the brightness averaging circuit 54 on line 58 is applied to the B input of a first divider 80. The A input of the divider is connected to a brightness reference source 82 which provides a voltage level corresponding to the average brightness of an optimum visually acceptable image on the monitor 52. The output of the first divider 80, designated the BRIGHTNESS RATIO, represents the ratio produced by dividing input voltage B into input voltage A as denoted by the designation A/B. Thus if the BRIGHTNESS RATIO is greater than one, the measured average brightness is less than the reference level. On the other hand, if the BRIGHTNESS RATIO calculated by the first divider 80 is less than one, the measured average brightness is above the reference level. A ratio value of one indicates that the desired brightness level exists. Furthermore, the magnitude of the BRIGHTNESS RATIO indicates the degree to which the average brightness deviates from the reference level.

The output from the first divider 80 representing the ratio of the measured brightness to the reference brightness level, is applied to a pulse width command circuit 84. This circuit 84 responds to the brightness ratio by generating the digital PULSE WIDTH COMMAND on output line 85. Conventional circuitry, such as that disclosed in the aforementioned U.S. Pat. No. 4,703,496 may be utilized to generate the PULSE WIDTH COMMAND in response to the BRIGHTNESS RATIO. The digital format of the PULSE WIDTH COMMAND is converted into the analog domain by a first digital to analog converter (DAC) 86 having its output connected via line 28 to the grid supply 26 shown in FIG. 1. The PULSE WIDTH COMMAND signal determines the rate and duration at which the grid supply 26 will be turned on to bias the X-ray tube 12 into an emissive state. This signal in turn determines the X-ray tube current to be applied during a pulsed fluoroscopic exposure. In the continuous fluoroscopic mode, the signal on line 28 regulates the grid bias voltage level.

The pulse width command circuit 84 also contains an internal latch which temporarily stores the PULSE WIDTH COMMAND until another command value is generated for the next video field of the exposure. The stored value in the latch is applied to a second output line 88 to produce a signal designated LAST RAD CONTROL. Therefore, as an average brightness value for a video field is received on line 58, the LAST RAD CONTROL signal represents the X-ray tube current derived for the previous video field. This signal is coupled via line 88 to a portion of the exposure control 60 which regulates the X-ray tube bias voltage in response to the brightness error. The bias voltage is adjusted concurrently with the pulse width and filament current adjustment as dictated by the PULSE WIDTH COMMAND.

Specifically, the LAST RAD CONTROL signal on line 88 is applied to the A input of a second divider 90 having its B input coupled to the output of a RAD control reference source 92. The RAD control reference source 92 produces a manually selected control voltage which corresponds to 95 percent of the maximum tube current in the continuous fluoroscopic mode and 95 percent of the maximum pulse width in the pulsed fluoroscopic mode. The extra five percent allows the pulse width command circuit 84 to correct for small underbrightness conditions without having to wait for the usually slower response of the bias voltage adjustment. In this way, the tube current or pulse width changes can correct for small brightness errors immediately. The output signal of the second divider 90 represents the voltage ratio of the LAST RAD CONTROL signal to the reference level from source 92. Thus, this output signal provides an indication of the degree to which the PULSE WIDTH COMMAND is approaching the limit on its capability to vary the tube current to produce the desired brightness.

The output of the second divider 90 is applied to the input of a tube bias voltage command circuit 94 along with the BRIGHTNESS RATIO signal from the first divider 80. The two signals are multiplied together within circuit 94 to produce a tube kV bias control ratio indicative of the bias voltage required for the desired image brightness level. This latter ratio is used to generate an output signal on line 95 which represents the bias voltage level for the X-ray tube 12. The details of the tube bias voltage command circuit 94 are shown in the aforementioned U.S. Pat. No. 4,703,496, which description is incorporated herein by reference. The output on line 95 of the tube bias voltage command circuit 94 is converted into the analog domain by a second digital to analog converter 96 to produce the kV command signal on line 24.

The X-ray tube current is a function of not only the grid pulse width, but also the temperature of the tube 12 as determined primarily by the filament current. To regulate the filament current, the digital PULSE WIDTH COMMAND signal indicative of the desired tube current is applied to a standard taper function circuit 98. The taper function assures that the X-ray dose on the entrance side of the patient (i.e. at the top surface 34 of table 33 in FIG. 1) does not exceed 10 R/min. during fluoroscopy. In order to provide this safeguard, the taper function circuit 98 also receives the digital KV COMMAND so that the circuit will have an indication of the X-ray tube bias voltage. The output from the taper function circuit 98 is fed to a third digital to analog converter 99 to produce the FILAMENT COMMAND signal which is supplied via line 18 to the filament supply 17 shown on FIG. 1.

As noted previously, the exposure control 60 modifies the x-ray tube excitation parameters in order to maintain a constant desired brightness level on the monitor 52. This desired brightness level is set in the brightness reference circuit 82. However, in extreme conditions, the tube excitation may be altered to produce the maximum allowable X-ray emission and yet still not produce an image on the monitor having the desired brightness. When such a condition exists, the video gain is adjusted as a last resort in an attempt to produce an image display having an acceptable brightness level.

To determine when the X-ray tube excitation parameters are approaching their maximum tolerable limits, the LAST RAD CONTROL signal on line 88 of FIG. 2 is applied to the A input of a third divider 100 which receives a signal at its B input from a maximum RAD control limit source 102. The RAD control limit source 102 generates a reference signal which corresponds to the PULSE WIDTH COMMAND for the maximum tolerable X-ray emission at the dose rate selected by the operator. Therefore, when the value of the PULSE WIDTH COMMAND numerically approaches its limit, the output of the third divider 100 will increase toward a numerical value of one.

Similarly, the X-ray tube bias voltage is evaluated to determine when it is approaching the maximum tolerable limit. However, unlike the output of the pulse width command circuit 84, the image brightness is not directly proportional to the KV COMMAND that defines the bias voltage. The relationship between the X-ray image brightness and the bias voltage also is a function of the characteristics of the particular X-ray tube 12. As a consequence, the KV COMMAND must be transformed into a brightness factor to provide a feedback signal that is compatible with the AVERAGE BRIGHTNESS and LAST RAD CONTROL signals. The tube bias voltage command circuit contains a look-up table memory (not illustrated), which is programmed by a technician, with a bias voltage to image brightness transformation values for the specific X-ray tube 12. The PULSE WIDTH COMMAND addresses the look-up table memory which produces an output corresponding to the equivalent image brightness. This equivalent brightness value is stored in a latch and applied to output line 97 as a LAST BRIGHTNESS FACTOR signal. Such conversion methods are well-known having been used in previous brightness control systems.

Referring still to FIG. 2, the LAST BRIGHTNESS FACTOR signal from the tube bias voltage command circuit 94 is applied to the A input of a fourth divider 104. The B input of the fourth divider 104 receives a reference value from a brightness factor limit source 106. The numerical ratio output from the fourth divider 104 approaches a value of one as the tube bias voltage approaches a level which produces the maximum tolerable X-ray dose from tube 12. The brightness factor corresponding to the maximum bias voltage level is set within the brightness factor limit source 106. The output of the fourth divider 104 is fed to one input of a first multiplier 108 which receives the BRIGHTNESS RATIO from the first divider 80 at another input. The product of the first multiplier 108 is applied to one input of a second multiplier 110 which receives the output from the third divider 100 at another other input. The output signal of the second multiplier 110 is designated the VIDEO GAIN RATIO, which in general terms has been calculated by the operation of components 100-110 as follows:

$$\left(\frac{\text{Brightness Ref.}}{\text{Present Brightness}}\right)\times\left(\frac{\text{LAST BRIGHTNESS FACTOR}}{\text{Brightness Factor Limit}}\right)\times\left(\frac{\text{LAST RAD CONTROL}}{\text{Max Rad Control Limit}}\right)$$

The VIDEO GAIN RATIO represents degree to which the gain of the video signal must be adjusted to maintain the image brightness at the level set by the brightness reference 82. As can be seen from the above equation, this ratio is dependent upon the magnitude that the present image brightness deviates from the reference level and how close the tube current and bias voltage are to their maximum limits.

The VIDEO GAIN RATIO signal on line 118 is applied as the control signal to a video gain command circuit comprising the remaining components 120–158 of the exposure control 60. The present exposure control 60 includes a unique video gain taper circuit 112 delineated by the dashed lines in FIG. 2. This taper circuit effectively varies the brightness reference level from a constant value to one which decreases as a function of the video gain that is required to maintain the image brightness at the level set by the brightness reference from source 82. The video gain that would produce the reference brightness level is designated "Demanded Video Gain" herein.

Figure 3:
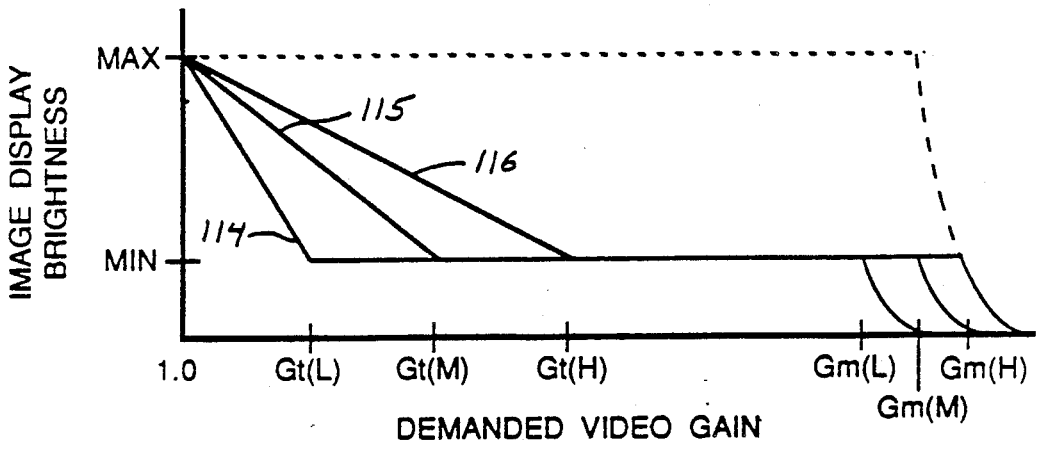
FIG. 3 is a graphical representation of the image display brightness as a function of the video gain.

As a result of the taper circuit 112, the image brightness actually decreases with increases in the Demanded Video Gain as graphically illustrated in FIG. 3. When the tube excitation parameters are being used exclusively to regulate the image brightness, the video gain is maintained at a unity. At this point, the average image brightness is maintained at the level set by the brightness reference 82, a level designated MAX. Previously under extreme conditions when the video gain was used to adjust the brightness, the brightness reference was maintained at this maximum level, as indicated by the dashed horizontal line on the graph. Eventually a gain limit was reached, further increases in video gain produced a drop-off in brightness.

The present video gain taper circuit 112 decreases the effective brightness reference level as the Demanded Video Gain increases so that the image brightness follows one of three taper lines 114, 115 or 116 depending upon which of the three exemplary dose levels (low, medium or high, respectively) the operator has selected for the X-ray exposure. As seen in the figure, each of the three tapers has a different slope, all of which eventually settle at a minimum brightness level (MIN), at which point the brightness is maintained constant despite further increases in the Demanded Video Gain. The lowest Demanded Video Gain level which produces the minimum brightness level is denoted by Gt(L), Gt(M) and Gt(H) for the low, medium and high dose rates, respectively. In determining the gain at each of these break points, a midrange value is assigned to Gt(M) and the values for the other points are determined from the following relationships:

$$Gt(L) = Gt(M) \times [Gm(L)/Gm(M)]$$
$$Gt(H) = Gt(M) \times [Gm(H)/Gm(M)]$$

where Gm(L), Gm(M) and Gm(H) are the maximum allowed video gain at each of the dose rates.

From the video gains at the minimum brightness level the slope of each linear taper function can be derived from the relationship:

$$\text{Slope}(i) = \left(\frac{BRT1(i) - BRT2(i)}{VG1(i) - VG2(i)}\right)$$

where i designates the low (L), medium (M) or high (H) dose rate taper line, BRT1 and VG1 are the brightness and the Demanded Video Gain at one point on that taper line, and BRT2 and VG2 are the corresponding parameter values at another point. Since the taper lines are defined by the points where the brightness is at a maximum value (MAX) when the Demanded Video Gain is one and where the taper line intersects the minimum brightness level (MIN), the generalized slope equation becomes:

$$\text{Slope}(i) = \left(\frac{\text{MAX} - \text{MIN}}{1 - Gt(i)}\right)$$

Knowing the slope for each of the taper functions allows the derivation of a tapered brightness reference value that corresponds to the image display brightness defined by the taper functions. The value of the tapered brightness reference (TBR) is given by the equation:

$$TBR = \left(\frac{BRT1 - BRT2}{VG1 - VG2}\right)(\text{Demanded Video Gain}) + \left(BRT1 - \left(\frac{BRT1 - BRT2}{VG1 - VG2}\right)\right)$$

where the Demanded Video Gain is the video gain that would be required to maintain the image brightness at the level set by the brightness reference source 82 (i.e. the MAX level in FIG. 3).

The use of the brightness taper functions provides a visual indication to the operator that the system is approaching the limit of its imaging capability, since the image begins to decrease in brightness with further increases in video gain. Furthermore, it has been determined that although as the video gain continues to increase, the noise becomes less perceptible to the viewer when the brightness of the image is lowered. As a result the use of the brightness taper functions allows a modest increase in video gain for the display more image information while providing the illusion that the noise intensity is not also increasing.

The video gain taper circuit 112 effectively alters the brightness reference level used by the video gain control circuit so as to process the video signal according to the functions illustrated in FIG. 3. Specifically, with reference again to FIG. 2, the VIDEO GAIN RATIO on line 118 is applied to one input of a third multiplier which also receives an input value, designated LAST VIDEO GAIN, representing the previously set gain level. The VIDEO GAIN RATIO is an error signal corresponding to the amount of the brightness error between the level set by brightness reference source 82 and the existing brightness for which error the video gain must compensate. The multiplication of the VIDEO GAIN RATIO with the LAST VIDEO GAIN signal in multiplier 120 produces the Demanded Video Gain level that indicates the video gain necessary to achieve the brightness level (MAX) set by the brightness reference source 82. There are limits to the magnitude of the video gain and hence to the Demanded Video Gain level which are defined by a limit circuit 122.

Components 124–129 apply the taper function for the selected exposure dose level to the Demanded Video Gain at the output of the limit circuit 122 to derive a tapered brightness reference level. Specifically, the operator has indicated via terminal 62 (FIG. 1) which of the three dose rates (low, medium or high) is to be used for the X-ray exposure. This dose rate information is applied via line 127 to a slope look-up table (LUT) 128 which provides the numerical value of the taper function slope for that dose level. Components 124–129 compute the tapered brightness reference (TBR) according to the equation given above. The taper function slope, stored in the look-up table 128, and the Demanded Video Gain from limit circuit 122 are applied to inputs of a fourth multiplier 124 to produce an output which represents the product of the two inputs. The brightness taper is defined as having a negative slope (see FIG. 3). Therefore, the products of the slope and the Demanded Video Gain from the fourth multiplier 124 will be a negative value. The final term of the tapered brightness reference equation is computed in an intercept circuit 129 which subtracts the slope from the output value (MAX) of the brightness reference source 82. The outputs from the fourth multiplier 124 and intercept circuit 129 are combined in adder 126 to produce the tapered brightness reference (TBR) value at node 130.

It should be noted that the arithmetic computation performed by components 124–129 may yield a value at node 130 for the tapered brightness reference which would produce a brightness level below the minimum level MIN at which the X-ray image still will be viewable. When this occurs, the tapered brightness reference must be forced to a value which produces the minimum brightness level as shown graphically in FIG. 3. To detect this condition, the output of adder 126 is applied to one input of a comparator 132 which receives a signal at its other input from circuit 134 indicative of the minimum brightness level (MIN). The output of the comparator 132 is applied to the control input of a first multiplexer 136 which selects either the output from the adder 126 or the minimum brightness level from circuit 134 to apply to its output. Thus, as long as the output from adder 126 is equal to or above the minimum brightness level, that output will be passed through the first multiplexer 136. However, if the output value from the adder 126 is below the minimum brightness level, the output from circuit 134 will be fed through the first multiplexer 136.

Thus, when the VIDEO GAIN RATIO indicates that the video gain should be greater than one, the video gain taper circuit 112 produces a tapered brightness reference value such that the video control will reach a quiescent state at a lower image brightness than that defined by the reference level from source 82. The output of the first multiplexer 136 representing the tapered brightness reference is applied to the A input of a fifth divider circuit 138. The other input of the fifth divider 138 receives the measured average brightness of the present X-ray image on line 58 (see also FIG. 1). The fifth divider 138 produces an output signal representing the deviation of the measured average brightness from a tapered reference level (a tapered brightness ratio). Therefore, if the output of the fifth divider 138 is greater than one, the present brightness is below the tapered brightness reference level; whereas if the output is less than one, the present brightness is above the tapered level.

The video signal processing circuitry for the imaging system 10 always has a gain equal to or greater than unity. In the instance where the image is too bright, video gain can be reduced to but not below unity, thereafter the X-ray tube excitation must be altered to reduce the X-ray dose rate in order to produce the desired image brightness. Therefore, comparator 140 is provided to compare the Demanded Video Gain signal from limit circuit 122 to a reference level (REF) which corresponds to unity gain. As long as the gain indicated by the signal from the limit circuit is at least equal to unity, the comparator 140 will produce a high logic level output which is applied to one input of AND gate 142. A control signal designated TAPER ENABLE is coupled to another input of AND gate 142. In some configurations, the operator may desire that the taper function be inactive, in which case the taper enable signal will be at a low logic level. Thus, the output of AND gate 142 will be a low logic level whenever the taper function is disabled or the Demanded Video Gain level is below unity. This low output from AND gate 142 is applied to the control terminal of a second multiplexer 144 which in response thereto couples the VIDEO GAIN RATIO from the second multiplier 110 to its output. In this instance, the exposure control 60 operates in the same manner as previous systems.

However, when video gain tapering is active, a high logic level TAPER ENABLE signal is applied to AND gate 142. In the active state when the Demanded Video Gain is above unity, the output of AND gate 142 is high, causing the second multiplexer 144 to pass the output from the fifth divider 138 to its output 145. Thus, the output from the second multiplexer 144 is a ratio which indicates the amount by which the LAST VIDEO GAIN control signal level must be altered to produce the tapered image brightness. This ratio is applied to one input of a fourth multiplier 146 which also receives as an input signal the LAST VIDEO GAIN level. The result of the multiplication in device 146 produces a new video gain level on output line 148 of the taper circuit 112.

This new video gain level is applied to a conventional zero error integrator function circuit 150, as has been done in previous automatic brightness control systems. This function compares the delta change between the new predicted video gain level and the previous video gain command level. A damping factor gain which is less than unity is applied from a circuit 154 to this delta change to minimize overshoot and to meet proper settling times the X-ray system. A slew limit factor generated by circuit 152 is used to maintain the predicted change within limits to which the system can respond at a given video field rate. The proper gain must be used to maintain resolution for small changes in brightness and to allow the system to operate with zero error when a large damping value is needed.

The output from the zero error integrator function circuit 150 is delayed by one video field interval by circuit 156 to provide the LAST VIDEO GAIN feedback signal when the average brightness of the next field is being processed. In addition, the digital output from circuit 150 is transformed by digital to analog converter 158 to produce the VIDEO GAIN COMMAND signal on line 65 for the video gain control circuit 46 shown in FIG. 1.

One skilled in the art, immediately will recognize that scale factors must be applied to the signals at different points in the circuit of FIG. 2 to insure that the arithmetic operations described operate on similar signal units. All conversion factors and scale factors are assumed to be contained within the appropriate function blocks.

As shown in FIG. 1, the video gain control 46 receives the VIDEO GAIN COMMAND from the exposure control 60 and determines the portions of the commanded gain to be provided by the camera iris 48 and by the video amplifier 50. The video gain is the product of the individual signal gains provided by these two components.

Previous video gain control systems used the iris size to produce the desired increase in video gain until the iris had to be opened fully at which point the electronic gain of the video amplifier was increased. However, the present video gain control 46 initially uses only the electronic gain to provide small required increases in video gain. If a large video gain level is commanded, where the electronic gain would have to increase above a set threshold (e.g. above a gain of two), the electronic gain remains at that set threshold and the balance of the commanded gain is provided by opening the iris aperture. When the commanded gain is so large that the opening the iris fully can not meet that commanded gain level, the electronic gain is increased above the set threshold while the iris remains fully open.

Figure 4:
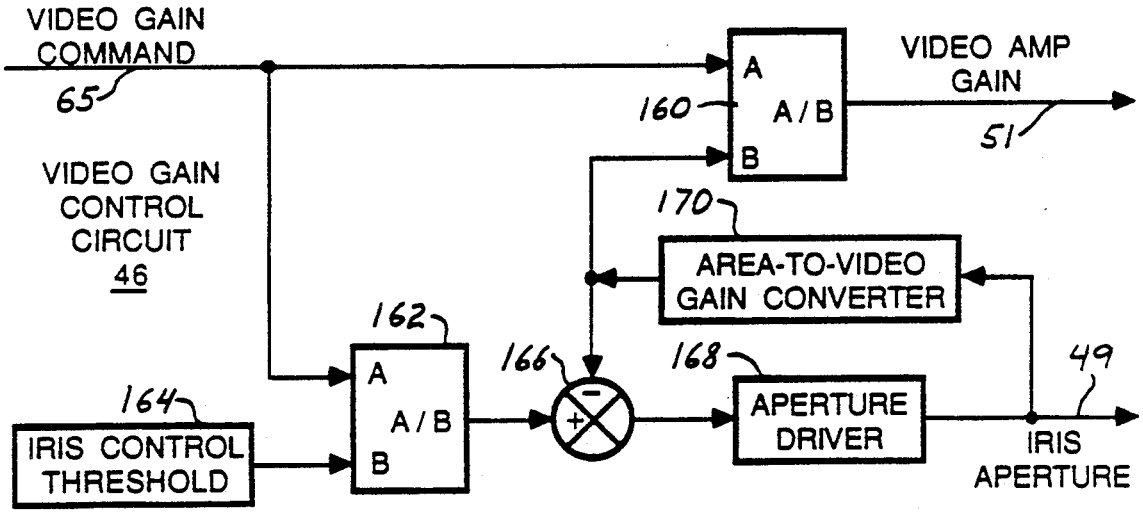
FIG. 4 is a block schematic diagram of the video gain control in FIG. 1.

With reference to FIG. 4, the video gain control 46 for performing this control technique is illustrated with discrete digital signal processing components, but also could be implemented with a microcomputer. As shown, the VIDEO GAIN COMMAND from the exposure control 60 is applied to the A inputs of two dividers 160 and 162. The second of these dividers 162 receives a threshold voltage from an iris control threshold circuit 164 which corresponds to the level of the VIDEO GAIN COMMAND at which the iris aperture is to commence being opened to provide video gain. When the VIDEO GAIN COMMAND on line 65 exceeds the iris control threshold, the output from divider 162 has a value that is greater than one. This output is applied to the non-inverting input of a summation circuit 166 having an output that is applied as a control signal to a conventional iris aperture driver 168. The output of the aperture driver is applied via line 49 to the camera iris 48 where it regulates the size of the iris aperture.

The output of the aperture driver 168 is also used as a feedback signal which is applied to the inverting input of summation circuit 166. However, since the iris aperture area is not directly proportional to the video gain signal, a converter 170 receives the output signal from the aperture driver on line 49 and converts it into a corresponding video gain level. This video gain feedback level is applied from the output of the converter 170 to the inverting input of the summation circuit 166 and to the B input of divider 160.

The operation of the video gain control 46 can best be understood using several specific examples. For these examples, it is assumed that the iris control threshold 164 is set at a VIDEO GAIN COMMAND level of two. In the first example, the VIDEO GAIN COMMAND on line 65 from the exposure control is greater than one but less than two. It also is assumed that the aperture for the camera iris 48 is presently at its minimum preset opening. Since the VIDEO GAIN COMMAND in this example is less than the iris control threshold from source 164, the output of divider 162 will be less than one. At the minimum iris aperture opening, the area to video gain converter 170 is producing an output level which is numerically equivalent to one. As a result, the output from summation circuit 166 will be a value which is less than zero. When this negative value is applied to the input to the aperture driver 168, the driver will not alter the iris aperture from its minimum preset opening.

However, the value of one from the output of the area to video gain converter 170 is also applied to the B input of divider 160 which will produce an output level corresponding to the ratio A/B of the input signals. The ratio of the gain provided by the iris aperture (as indicated by the output of the area to gain converter) to the video gain command represents the electronic gain component which must be provided by video amplifier 50. Thus, as long as the video gain command on line 65 is less than output from the iris control threshold source 164, the video gain will be provided entirely by the electronic gain of the amplifier 50.

As a second example, assume that the VIDEO GAIN COMMAND corresponds to a video gain of three and the iris control threshold remains at a gain factor of two. Thus, the ratio of the video gain command to the iris control threshold (3/2) produced by divider 162 will indicate an iris gain of 1.5. Assuming that the present iris aperture opening corresponds to a gain of one, the output of summation circuit.166 will indicate to the aperture driver 168 that the aperture should be opened to provide a gain of 1.5.

It should be noted that because of the electromechanical nature of the iris aperture control, this desired aperture gain may not be reached for several video field intervals. Therefore, divider 160 will have a video gain command of three applied to its A input and an initial iris gain feedback signal of one from the area to video gain converter 170. The initial video amplifier gain signal on line 51 will correspond to a gain of three, thereby compensating for the full commanded video gain level.

As the iris aperture begins to open, the output of the area to video gain converter 170 will increase producing an corresponding decrease in the video amplifier gain signal on line 51. Eventually, the iris 48 will open to a position which provides the desired iris gain of 1.5. At this point, both inputs to summation circuit 166 will correspond to a gain value of 1.5 providing an output signal which holds the aperture driver 168 at its current output level to maintain the present iris aperture size. At this time, the iris gain feedback signal from the area to video gain converter 170 equaling a gain of 1.5 will be applied to the B input of divider 160. This feedback signal, when divided into the video gain command of three, will produce a signal on line 51 for a video amplifier gain of two which corresponds to the iris control threshold from source 164. As the VIDEO GAIN COMMAND on line 65 directs larger video gain levels, the video amplifier gain on line 52 will remain held at a gain factor of two with the balance of the commanded video gain being provided by the iris aperture.

Under extreme conditions, the VIDEO GAIN COMMAND on line 65 may direct a video gain level beyond that which can be provided by fully opening the iris aperture. When this occurs, even though the output of the summation circuit 166 instructs the aperture driver 168 to continue opening the iris to provide more gain, the iris 48 mechanically cannot be opened farther. In this case, additional gain is needed to reach the commanded level. This additional gain must be provided by increasing the electronic gain of the video amplifier 50 above the iris gain control threshold.

For example, assume that the desired gain as dictated by the VIDEO GAIN COMMAND on line 65 is six and the maximum gain which can be provided by the iris is 2.5. Therefore, the ratio of the iris control threshold (a gain of two) with the commanded video gain will produce an output from divider 162 indicating that an iris gain of three is required. However, the maximum gain that can be obtained from opening the iris fully is 2.5. Therefore, when the iris 48 is opened to its full value, the feedback signal at the output of the area to video gain converter 170 will indicate a video gain from the iris of 2.5. In this state, the output of the summation circuit 166 continues to indicate that additional gain is to be required from the iris 48. However, the aperture driver 168 will not respond further since the aperture is at its limit.

The iris gain feedback signal from converter 170 also is applied to the B input of divider 160 which produces an video amplifier gain signal indicating a gain of 2.4 must be obtained from the amplifier 50. This output level corresponds to the ratio of the video gain command on line 63 to the amount of video gain provided by the iris 48 (i.e. a ratio of 6/2.5). Therefore, when the commanded video gain exceeds a level which corresponds to the product of the iris control threshold and the maximum iris gain, the electronic gain will increase above the level set by the iris control threshold.

In this example, the speed at which the iris can provide more video gain lags behind the speed at which the electronic gain can be altered. Therefore, the full increase in video gain to a factor of six initially will be provided by the amplifier 50. However, as the iris opens, the electronic gain will decrease to provide the gain of 2.4 once the iris is fully open.

The inverse action occurs when the video gain is to be decreased. Initially, the electronic gain will be decreased until it reaches the level set by the iris control threshold source 164. If further gain reduction is called for, the iris 48 will be closed until it reaches its minimum preset opening. Thereafter, an additional video gain decrease will be achieved by lowering the electronic gain provided by amplifier 50. As with the previous examples, since the electro-mechanical control of the aperture gain is slower than the electronic gain, the electronic gain will initially decrease to a level which provides the entire commanded decrease in the video gain, but thereafter will increase as a portion of the gain decrease is provided by the closing iris.

What is claimed is:

1. In an fluoroscopic imaging system having an X-ray tube that when excited emits an X-ray beam, an apparatus which converts an image produced by the X-ray beam into a video signal and applies video gain to the video signal, and means for displaying a video image from the video signal; the improvement comprising a circuit for controlling the brightness of the video image comprising:

means for determining a deviation of the brightness of the video image from a brightness reference level;

means, responsive to said means for determining, for altering the excitation of the X-ray tube to reduce the deviation of the brightness of the video image from the brightness reference value;

means for indicating the degree to which said means for altering the excitation of the X-ray tube is unable to eliminate the deviation of the brightness of the video image from the brightness reference value, means, responsive to said means for indicating, to produce an indication designated "Demanded Video Gain" representing the video gain necessary in order for the brightness of the video image to equal the brightness reference value; and means for varying the video gain such that, as the Demanded Video Gain increases, the video gain is varied to decrease the brightness of the video image.

2. The circuit as recited in claim 1 wherein said means for altering the excitation of the X-ray tube includes means for producing a first signal indicating an electron beam current level to be produced in the X-ray tube; and means for producing a second signal indicating a bias voltage level to be applied between an anode and a cathode of the X-ray tube.

3. The circuit as recited in claim 2 wherein said means for altering the excitation of the X-ray tube initially varies the first signal to reduce the brightness deviation; and if varying the first signal alone is insufficient to eliminate the brightness deviation, said means for altering the excitation of the x-ray tube also varies the second signal.

4. The circuit recited in claim 1 wherein said means for varying the video gain includes means for producing a tapered brightness reference value (TBF) given by the linear function:

TBF=m (Demanded Video Gain)+b where m is the slope of the linear function having a negative value and b is a constant.

5. The circuit recited in claim 4 wherein the slope m of the of the linear function is defined by:

$$m = \left( \frac{BRT1 - BRT2}{VG1 - VG2} \right)$$

and the constant b is defined by:

$$b = \left( BRT1 - \left( \frac{BRT1 - BRT2}{VG1 - VG2} \right) \right)$$

where BRT1 is the video image brightness produced at a first known value VG1 of Demanded Video Gain, and BRT2 is the video image brightness produced at a second known value VG2 of Demanded Video Gain.

6. The circuit as recited in claim 4 wherein said means for varying the video gain utilizes one of a plurality of predefined sets of values for m and b for the linear function depending upon which one of an equal plurality of X-ray dosages is selected for a given exposure.

7. The circuit recited in claim 4 wherein said means for varying the video gain further includes:

means for comparing the brightness of the video image to the tapered brightness reference value; and means for producing a video gain value in response to said means for comparing the brightness of the video image.

8. The circuit recited in claim 4 wherein said means for varying the video gain does not produce a tapered brightness reference value that is less than a minimum value.

9. The circuit recited in claim 1 wherein said means for varying the video gain does not decrease the brightness of the video image below a minimum level (MIN).

10. The circuit recited in claim 1 wherein the apparatus which converts an image produced by the X-ray beam into a video signal includes a variable optical iris and a variable gain amplifier, and wherein said means for varying the video gain comprises:

means for varying the gain of the amplifier until a given gain threshold is reached and thereafter inhibiting further variation of the gain of the amplifier until the optical iris is substantially at a maximum aperture opening; and means for varying the optical iris after the gain of the amplifier reaches the given gain threshold.

11. The circuit recited in claim 1 wherein the apparatus which converts an image produced by the X-ray beam into a video signal includes a variable optical iris and a variable gain amplifier, and said circuit for controlling the brightness of the image further comprising:

means for comparing a desired video gain level to a iris control threshold;

means for altering an aperture size of the iris when said means for comparing indicates that the desired video gain level exceeds the iris control threshold;

means for deriving a value corresponding to video gain level provided by the iris; and means for varying the gain of the amplifier in response to the difference between the value corresponding to video gain level provided by the iris and the desired video gain level.

12. The circuit as recited in claim 1 wherein said means for varying the video gain utilizes one of a plurality of predefined arithmetic functions to determine a level for the video gain in response to the Demanded Video Gain depending upon which one of an equal plurality of X-ray dosages is selected for a given exposure.

13. In an fluoroscopic imaging system having an X-ray tube that when excited emits X-rays, means for converting an X-ray image into a visible light image, a camera for producing an electrical signal representing the visible light image, means for displaying a video image from the signal; the improvement comprising a circuit for controlling the brightness of the video image comprising:

means for deriving an indication of the brightness of the video image;

means for comparing the video image brightness indication to a brightness reference value to determine a deviation from the brightness reference value;

means, responsive to said means for comparing, the video image brightness indication for altering the excitation of the X-ray tube to reduce a deviation of the derived image brightness indication from the brightness reference value;

means for indicating when said means for altering the excitation of the X-ray tube is approaching the limit of the latter means ability to alter the excitation of the x-ray tube;

means, which responds to said means for indicating when the means for altering the excitation of the x-ray tube is approaching the limit, for varying a gain applied to the electrical signal to thereby alter the brightness of the video image so that the brightness of the image decreases as the present means is required to compensate for more of the brightness deviation.

14. The circuit as recited in claim 13 wherein said means for altering the excitation of the X-ray tube includes:

a first means for varying an electron beam current of the X-ray tube; and a second means for varying a bias voltage applied to the X-ray tube;

wherein said first means for varying initially alters the electron beam current to reduce the brightness deviation, but when varying the electron beam current alone is insufficient to eliminate the brightness deviation, said second means for varying alters the bias voltage to further reduce the brightness deviation.

15. The circuit recited in claim 13 wherein said means for varying the gain determines the gain to be applied to the electrical signal utilizing the following relationship:

$$\text{Gain} = \left(\frac{BRT1 - BRT2}{DG1 - DG2}\right)(\text{Demanded Gain}) + \left(BRT1 - \left(\frac{BRT1 - BRT2}{DG1 - DG2}\right)\right)$$

where the Demanded Gain is the amount of gain that is required to maintain the brightness of the video image at a level defined by the reference value, BRT1 is the video image brightness produced at a first known value DG1 of Demanded Gain, and BRT2 is the video image brightness produced at a second known value DG2 of Demanded Gain.

16. The circuit recited in claim 13 wherein said means for varying the gain does not decrease the brightness of the video image below a minimum level.

17. In an fluoroscopic imaging system having a vacuum tube with a filament, a cathode and an anode that emits an X-ray beam, a converter responsive to the X-ray beam for producing a video signal representing an image produced by the X-ray beam and means for displaying a video image from the signal; the improvement comprising a circuit for controlling the brightness of the video image comprising:

means for deriving an indication of the brightness of the video image;

a first means for comparing the image brightness indication to a brightness reference value and producing a first control signal indicative of the relationship of the two compared signals;

means, responsive to the first control signal, for applying a filament current to the vacuum tube to reduce a deviation of the image brightness indication from the brightness reference value;

a second means for comparing the applied filament current to a current reference value and producing a second control signal indicative of the relationship therebetween;

means, responsive to the first and second control signals, for applying a bias voltage across the X-ray tube anode and cathode to further reduce a deviation of the image brightness indication from the brightness reference value;

a third means for comparing the applied X-ray tube bias voltage to a bias voltage limit and producing a third control signal indicative of the relationship therebetween;

a fourth means for comparing the applied filament current to a current limit and producing a fourth control signal indicative of the relationship therebetween;

means, responsive to the first, third and fourth control signals, for generating a fifth control signal indicative of an amount of gain for the video signal that is required to eliminate a deviation of the image brightness indication from the brightness reference value; and means for applying video gain to the video signal wherein the video gain varies in proportion to the fifth control signal such that the brightness of the video image decreases as the fifth control signal indicates that the video gain must increase to eliminate the specified deviation.

18. The circuit recited in claim 17 wherein said means for applying video gain includes:

means for producing a tapered brightness reference value (TBF) given by the linear function:

$$TBF = \left(\frac{BRT1 - BRT2}{VG1 - VG2}\right)(\text{Demanded Video Gain}) + \left(BRT1 - \left(\frac{BRT1 - BRT2}{VG1 - VG2}\right)\right)$$

where the Demanded Video Gain is the level of video gain that is required to maintain the brightness of the video image at the brightness defined by the reference value, BRT1 is the video image brightness produced at a first value VG1 of Demanded video Gain, and BRT2 is the video image brightness produced at a second value VG2 of Demanded Video Gain;

means for comparing the brightness of the video image to the tapered brightness reference value; and means for producing a video gain value in response to said means for comparing.

19. The circuit recited in claim 18 wherein said means for producing a tapered brightness reference value includes means which prevents the tapered brightness reference value from being less than a minimum level.

20. The circuit for controlling the brightness of the image as recited in claim 18 wherein the converter includes a variable optical iris and a variable gain amplifier, and further comprising:

a fifth means for comparing a desired video gain level to an iris control threshold;

means for altering an aperture size of the iris when said fifth means for comparing indicates that the desired video gain level exceeds the iris control threshold;

means for deriving a value corresponding to a video gain level provided by the iris; and means for varying the gain of the amplifier in response to the difference between the value corresponding to a video gain level provided by the iris and the desired video gain level.

21. In an fluoroscopic imaging system having an X-ray tube that when excited emits an X-ray beam, an apparatus which converts an image produced by the X-ray beam into a video signal which apparatus has a variable optical iris and a variable gain amplifier to apply video gain to the signal, and means for displaying a video image from the signal; the improvement comprising a circuit for controlling the brightness of the video image comprising:

means for determining a deviation of the brightness of the video image from a brightness reference level;

means, responsive to said means for determining, for altering the excitation of the X-ray tube to reduce the deviation of the brightness of the video image from the brightness reference value;

means for indicating the degree to which said means for altering the excitation of the X-ray tube is unable to eliminate the deviation of the brightness of the video image from the brightness reference value, means, responsive to said means for indicating, for producing an indication of a desired video gain to be applied to the signal;

means for producing the desired video gain by adjusting the gain of the amplifier when the gain of the amplifier is below a threshold level, when the gain of the amplifier is adjusted to the threshold level and additional video gain is desired only the optical iris is adjusted until the optical iris is substantially at a maximum aperture opening, at which point if additional video gain is desired the gain of the amplifier is adjusted again.

22. The circuit recited in claim 21 wherein said means for producing an indication of a desired video gain produces an indication which results in the brightness of the video image decreasing as the desired video gain increases in magnitude.

23. The circuit recited in claim 21 wherein said means for producing an indication includes:

means for deriving a tapered brightness reference value in response to said means for indicating;

means for comparing the brightness of the video image to the tapered brightness reference value; and means for generating the indication of a desired video gain value in response to said means for comparing.

* * * * *